US006138093A

United States Patent [19]

Ekudden et al.

[11] Patent Number: 6,138,093

[45] Date of Patent: Oct. 24, 2000

[54] HIGH RESOLUTION POST PROCESSING METHOD FOR A SPEECH DECODER

[75] Inventors: Erik Ekudden, Åkersberga; Roar Hagen, Stockholm; Bastiaan Kleijn, Tullinge, all of Sweden

[73] Assignee: Telefonaktiebolaget LM Ericsson, Stockholm, Sweden

[21] Appl. No.: 09/032,942

[22] Filed: Mar. 2, 1998

[30] Foreign Application Priority Data

Mar. 3, 1997 [SE] Sweden ..... 9700772

[51] Int. Cl.[7] ..... G10L 19/02

[52] U.S. Cl. ..... 704/228; 704/205; 704/226

[58] Field of Search ..... 704/203, 205, 704/211, 226, 227, 228, 233, 278

[56] References Cited

U.S. PATENT DOCUMENTS

| | | | |
|---|---|---|---|
| 5,133,013 | 7/1992 | Munday | 704/226 |
| 5,479,560 | 12/1995 | Mekata | 704/209 |
| 5,539,859 | 7/1996 | Robbe et al. . | |
| 5,550,924 | 8/1996 | Helf et al. . | |
| 5,710,862 | 1/1998 | Urbanski | 704/226 |

FOREIGN PATENT DOCUMENTS

0637012 A2 2/1995 European Pat. Off. .

0658875 A2 6/1995 European Pat. Off. .

*Primary Examiner*—Richemond Dorvil
*Assistant Examiner*—Abul K. Azad
*Attorney, Agent, or Firm*—Burns, Doane, Swecker & Mathis, L.L.P.

[57] ABSTRACT

A post-processing method for a speech decoder which outputs a decoded speech signal in the time domain provides high frequency resolution based on a frequency spectrum having non-harmonic and noise deficiencies. This is obtained by transforming the decoded time domain signal to a frequency domain signal by using a high frequency resolution transform (FFT). Then an analysis of the energy distribution of the frequency domain signal is made throughout its frequency area (4 kHz) to find the disturbing frequency components and to prioritize such frequency components which are situated in the higher part of the frequency spectrum. Next, the suppression degree for the disturbing frequency components is found based on prioritizing. Finally the steps of controlling a post-filtering of the transform in dependence of the finding, and inverse transforming the post-filtered transform in order to obtain a post-filtered decoded speech signal in the time domain are performed.

8 Claims, 2 Drawing Sheets

HIGH RESOLUTION POST PROCESSING METHOD FOR A SPEECH DECODER

TECHNICAL AREA

The present invention relates to a post processing method for a speech decoder to obtain a high frequency resolution. The speech decoder is preferably used in a radio receiver for a mobile radio system.

DESCRIPTION OF PRIOR ART

In speech and audio coding it is common to employ post-processing techniques in the decoder in order to enhance the perceived quality of the decoded speech.

Post-processing techniques, such as traditional adaptive postfiltering, are designed to provide perceptual enhancements by emphasising formant and harmonic structures and to some extent de-emphasise formant valleys.

The present invention proposes a novel technique for post-processing which includes a high resolution analysis stage in the decoder. The new technique is more general in terms of noise reduction and speech enhancements for a wide range of signals including speech and music.

There is no known solution to a post-processing scheme for speech or audio coders which uses an analysis of the received parameters and the spectrum of the received signal to estimate a more precise coding noise level, combined with highly (non-harmonic) frequency selective de-emphasis filtering.

The formant postfilters in LPC based coders where the filter is derived from the received LPC parameters are well known. It does not make use of the spectral fine structure, and provides very limited frequency resolution.

Various types of LTP postfilters are well known. These filters can only affect the overall harmonic structure of the decoded signal, and can although providing high frequency resolution not address non-harmonic localised coding noise or artifacts. They are also particularly tailored to speech signals.

It is also known that analysis of the decoded speech at the receiver side can be used to estimate parameters in for example a pitch postfilter. This is performed in the LD-CELP for example. This is however only a harmonic pitch postfilter, where the "analysis" is only aimed at finding the pitch harmonics. No overall analysis of where the actual coding noise problems and artifacts are located is performed.

Relatively frequency selective "postfilters" have also been proposed in the context of removing frequency regions not coded by a very low bit-rate coder [1].

SUMMARY OF THE INVENTION

Many speech coders, e.g. LPC-based analysis-by-synthesis (LPAS) coders, make use of an error criterion in the parameter search which has very limited frequency selectivity. Further, the waveform matching criterion in many such coders will limit the performance for low energy regions, such as the spectral valleys, i.e. the control of the noise distribution in these frequency areas is much less precise.

When spectral noise weighting is used in the coder, the overall error spectrum, i.e. the coding noise, is spectrally shaped, although limited by the frequency resolution of the weighting filter. However, there may still be spectral regions, typically in spectral valleys or other low energy regions, with relatively high noise or audible artifacts which limit the perceived quality. For a given bit-rate, coder structure and input signal, the coder can only achieve a certain noise level. The relatively poor frequency selectivity in the coder and the post-processing, and the limiting bit-rate can not attack the quality problem areas for all types of signals.

A traditional bandwidth expanded LPC formant postfilter with low order (typically $10^{th}$ order) has relatively low frequency selectivity and can not address localised noise or artifacts.

Harmonic pitch postfilters can provide high frequency resolution, but can only perform harmonic filtering, i.e. not localised non-harmonic filtering.

Speech and music signals, for example, have fundamentally different structures and should employ different post-processing strategies. This can not be achieved unless the received signal is analysed and high resolution selective filters are used in the post-processing. This is not done presently.

The object of the present invention is to obtain a high frequency resolution post-processing method for the decoded signal from a speech or audio decoding device which at least reduces not desired influence of the non-harmonics and other coding noise in the decoded frequency spectrum.

The decoded signal is analysed to find likely frequency areas with coding noise. The high-resolution analysis is performed on the spectrum of the decoded speech signal and based on knowledge about the properties of the speech coding algorithm combined with parameters from the speech decoder. The output of the analysis is a filtering strategy in terms of frequency areas where the signal is de-emphasised to reduce coding noise and enhance the overall perceived quality of the coded speech.

The method of the invention utilises a transform that gives a high frequency resolution spectrum description. This may be realized using the Fourier transform, or any other transform with a strong correlation to spectral content. The length of the transform may be synchronized with the frame length of the decoder (e.g. to minimise delay), but must allow for a sufficiently high frequency resolution.

After the transformation, analysis of the spectral content and decoder attributes is made in order to identify problem areas where the coding method introduced audible noise or artifacts. The analysis also exploits a perceptual model of human hearing. The information from the decoder and the knowledge about the coding algorithm help estimate the amount of coding noise and its distribution.

The information derived in the analysis step and the perceptual model are used for a filter design in two steps:

The frequency areas to de-emphasise are determined.

The amount of filtering in each area is determined.

This gives a candidate filter which may be further refined in terms of dynamic properties. For instance, the filter characteristic may be unsuitable because it produces artifacts when used following previous filters. Also, the dynamic properties of the decoded signal can be taken into account by limiting the amount of change in the filtering as compared to how much the decoded signal is changing.

The strategy for filter design described above allows for very frequency selective postfiltering which is targeted at adaptively suppressing problem areas. This is in contrast to current general-purpose postfiltering that is always applied without a specific analysis. Furthermore, the method allows for different filtering for different types of signals such as speech and music.

The filtering of the decoded signal must be performed with high frequency resolution. The filter can for instance be implemented in the frequency domain and finally followed by an inverse transform. However, any alternative implementation of the filtering process may be used.

In an alternative low-delay implementation of the proposed solution, the filtering may be performed using the result from the analysis and filter design obtained in previous frames only. The delay incurred by the alternative implementation of the solution could then be kept very low.

BRIEF DESCRIPTION OF THE DRAWINGS

The method according to the present invention will be described in detail with reference to the accompanying drawings in which.

DESCRIPTION OF PREFERRED EMBODIMENTS

Figure 3:
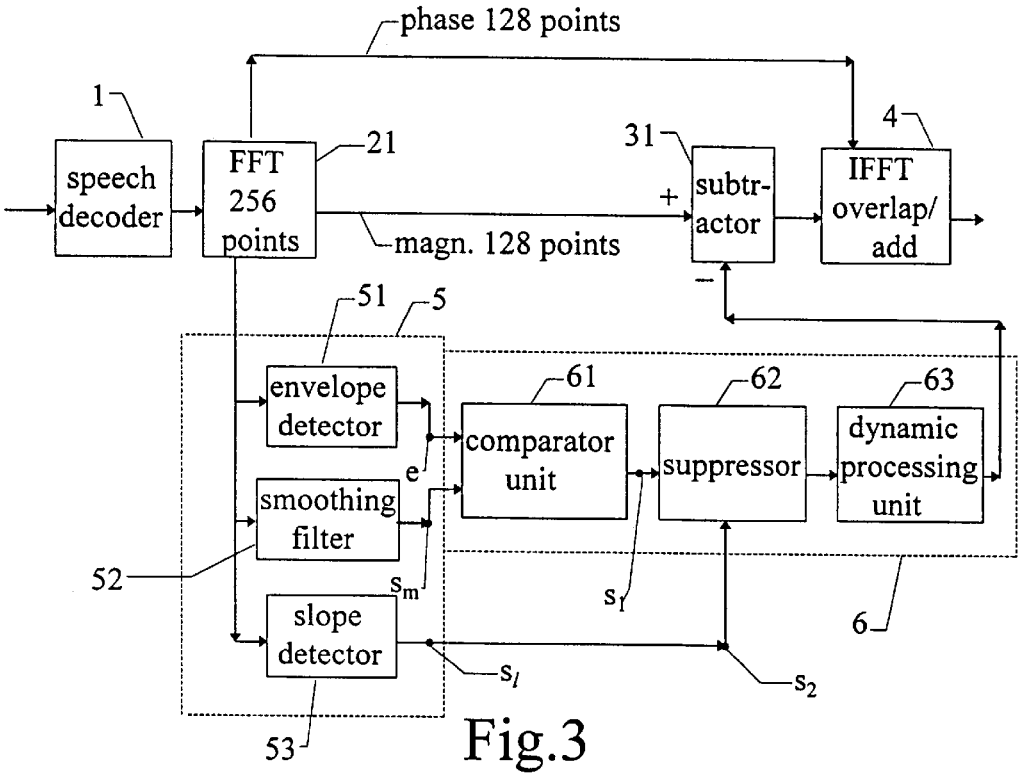
FIG. 3 shows a more detailed block diagram of the analysis and the filter design of FIGS. 1 and 2.

The following description illustrates a working implementation of the invention described above. It is designed for use with a CELP (Code Exited Linear Predictive) coder. Such coders tend to generate noise in low energy areas of the spectrum and especially in valleys between peaks that have a complex non-harmonic relation as, for instance, music. The following points and FIG. 3 illustrate the detailed implementation.

Figure 1:
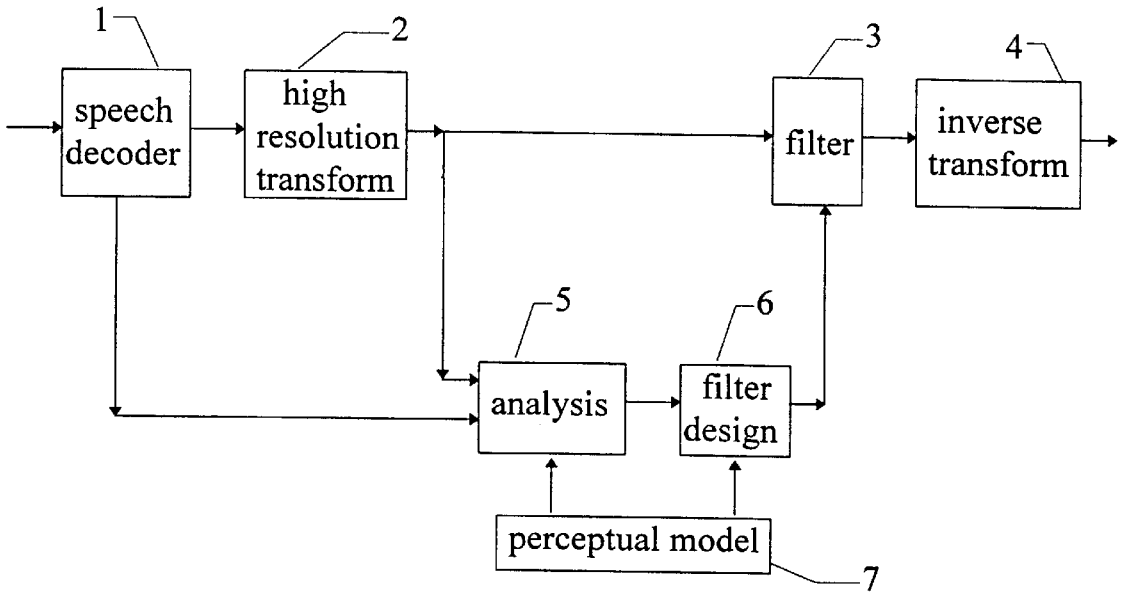
FIG. 1 shows a block diagram of the different functional blocks to perform the method according to one embodiment of the present invention.

FIG. 1 is a block diagram of the various functions performed by the present invention. A speech decoder 1, for instance in a radio receiver of a mobile telephone system decodes an incoming and demodulated radio signal in which parameters for the decoder 1 have been transmitted over a radio medium.

On the output of the decoder a decoded speech signal is obtained. The frequency spectrum of the decoded signal has a certain characteristics due to the transmission and to the decoding characteristics of the speech decoder 1.

The decoded signal in the time domain is converted by a Fast Fourier Transformation FFT designated by block 2 so that a frequency spectrum of the decoded signal is obtained. This frequency spectrum together with the frequency characteristics of the speech decoder are analysed, block 5, and the result of the analysis is supplied to a filter design unit 6. This design unit 6 gives an information signal to the post-filter 3. This filter performs a post-filtering of the frequency spectrum of the speech signal in order to eliminate or at least reduce the influence of the noise components in the decoded speech signal spectrum. The spectrum signal from the filter 3 which is free from disturbing frequency components or at least with strongly reduced disturbing components, is fed to a block 4 where the inverse transformation to that in block 2 is performed.

A perceptual model 7 can be added to the analysis and the filter design which influences the filtering (block 3) of the decoded speech signal spectrum as desired. This does not form any essential part of the present method and is therefore not described further.

In general terms, the spectral content of the decoded signal is analyzed in the following way in order to obtain measures that are used for identifying areas to de-emphasise.

The envelope of the magnitude spectrum is estimated in order to separate the overall spectral shape from the high resolution fine structure. The envelope may be estimated by a peak-picking process using a sliding window of sufficient width.

Smoothing of the magnitude spectrum may be performed to avoid ripple.

The resulting two vectors are used to identify sufficiently narrow spectral valleys of a certain depth. This gives candidate areas where filtering may be applied.

The spectrum may also be analyzed using a perceptual model to obtain a noise masking threshold.

The attributes from the decoder are analyzed in order to estimate a likely distribution and level of noise or artifacts introduced by the specific coder in use. The attributes are dependent on the coding algorithm but may include for instance: spectral shape, noise shaping, estimated error weighting filter, prediction gains—for instance in LPC and LTP, bit allocation, etc. These attributes characterize the behaviour of the coding algorithm and the performance for coding the specific signal at hand.

All, or parts of, the information about the coded signal derived is output from the analysis 5 and used for filter design 6.

Figure 2:
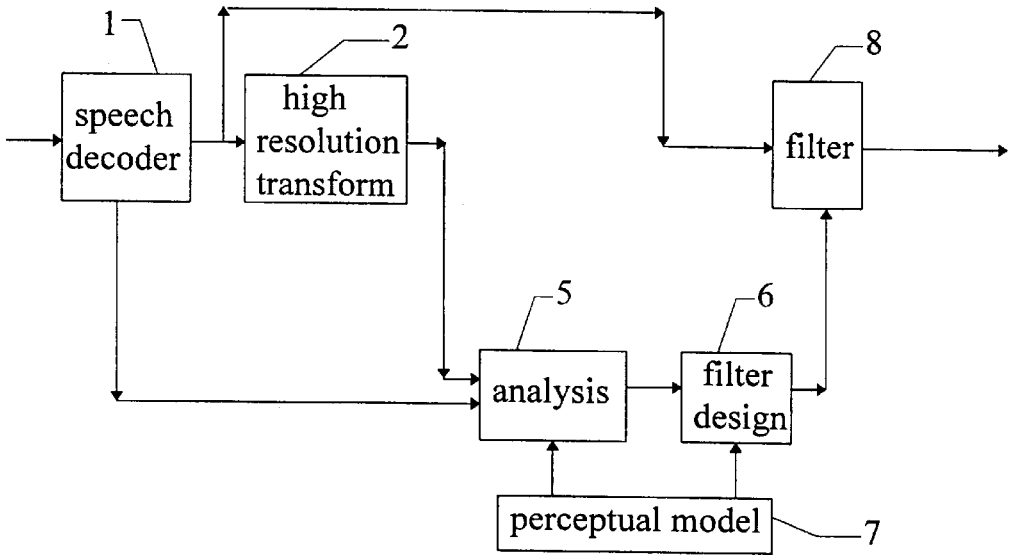
FIG. 2 shows a block diagram of another embodiment of the method according to the present invention.

In FIG. 2, another embodiment of the post-processing method is shown. The difference from FIG. 1 is that the analysis 5 and the filter design 6 is carried out in the frequency domain, while the post-filtering 8 of the decoded speech signal is carried out in the time domain. The output of the filter design unit 6 gives an information/control signal but now to the time domain filter 8 instead of the frequency domain filter 3 above.

FIG. 3 shows a more detailed block diagram than FIGS. 1 and 2 for illustrating the inventive method.

The output of the speech decoder 1 in, for instance, a radio receiver is connected to a functional block 21 performing a 256 point Fast Fourier Transformation (FFT). A 256-point FFT is then performed every 128 samples using a Hanning window. Thus, every 128 samples a new block is processed. The log-magnitude of the FFT transform is computed along with the phase spectrum (which is not processed).

The analysis (block 5) consists of:

Estimating the envelope of the log-magnitude spectrum by computing each frequency point as the maximum of the log-magnitude spectrum within a sliding window of length 200 Hz in each direction. Peak-picking on the resulting vector is done by finding the frequency points where the log-magnitude spectrum equals the maximum value vector. Linear interpolation is performed between the peaks to get the envelope vector.

Smoothing the log-magnitude spectrum by taking the maximum within a sliding window of length 75 Hz in each direction.

Estimating the slope of the spectrum.

The filter design (block 6) consists of determining the areas where the smoothed log-spectrum curve is lower than the log-magnitude envelope curve by more than a specific value. These areas are suppressed if they correspond to more than one consecutive frequency point. Furthermore, if the valley is deeper than a certain high value, the suppression is widened to include the entire area between the peaks. The amount of spectral suppression in the log-domain at each frequency point to be suppressed is determined by the slope such that low energy areas get more suppression. The formula used is linear in the log-domain with no suppression for the last 1 kHz at the low end of the suppression (i.e. for a low-pass slope, the first 1 kHz is not suppressed and the other way around for an high-pass slope). This is done because of the character of the CELP coder which tends to generate more noise for low energy frequency areas.

The squared distance of the log-magnitude spectrum between the current and previous spectrum is computed along with the same measure for the suppression vectors. If the ratio of the values for the suppression vector and the spectrum itself is higher than a certain value (i.e. the suppression changes relatively too much compared to the signal spectrum), the suppression vector is smoothed by simply replacing it by the average of the current and previous suppression.

The filtering operation (block 31) is performed by simply subtracting the amount of suppression determined in the previous point from the log-magnitude spectrum of the decoded signal.

The inverse transform (block 4) is performed by first reconstructing the Fourier transform from the log-magnitude spectrum resulting from the filtering and the phase spectrum as passed directly from the transform. Note that an overlap and add procedure is employed to avoid artifacts because of discontinuities between the analysis frames.

The analysis block 5 of FIG. 1 consists in this embodiment of an envelope detector 51, a smoothing filter 52 and a slope detector 53.

Figure 4:
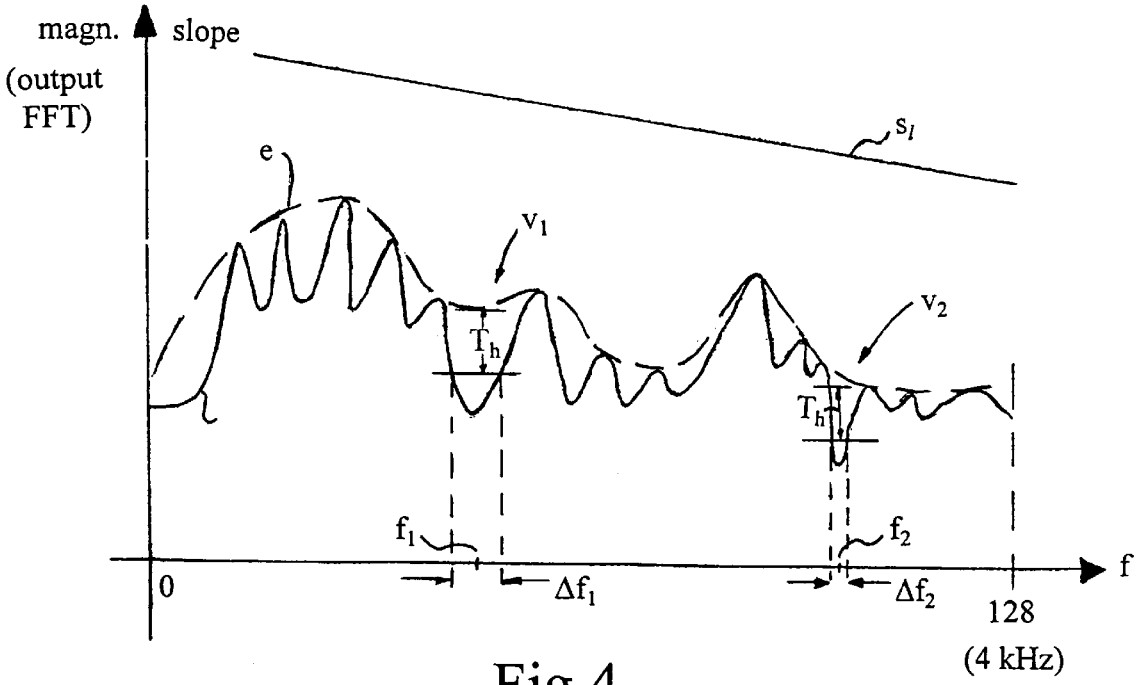
FIG. 4 shows a diagram which illustrates the frequency spectrum of a decoded signal and the principles of the post-processing according to the present invention.

From the envelope detector the envelope signal e of the FFT-spectrum is obtained as shown in the diagram of FIG. 4. The smoothing filter 52 gives a signal $s_m$ representing the smoothed frequency characteristic from the FFT, block 21.

The filter design unit 6 consists in this embodiment of a comparator unit 61, a suppressor 62 and a unit 63 performing a dynamic processing.

The two signals e and $s_m$ from the analysis block 5 are combined in the comparator unit 61. The difference between signals e and $s_m$ is compared with a fix threshold $T_h$ in the comparator 61 in order to determine a non-desired formant valley and the associated frequency interval. A signal $s_1$ is obtained which contains information about these.

The suppressing value forming unit 62 is controlled by a signal $s_2$ obtained from the slope unit 53 in the analyse block 5. Signal $S_2$ indicates the slope and in dependence on the slope value more or less suppression is performed on the frequency spectrum determined by signal $s_1$.

The dynamic unit 63 performs an adaption of the suppression from one frame to another so that sudden increase in suppression indicated in the output signal from the suppression unit 62 do not happen.

The filter 3 of FIG. 1 is in the embodiment according to FIG. 3 a filter 31 (corresponding to filter 3 in FIG. 1), called a subtractor in FIG. 3, which performs a spectral subtraction. The signal value obtained from the dynamic unit 63 is the suppression value and is then subtracted from the frequency spectrum characteristic obtained from the FFT unit 21 within the frequency intervals determined by the signal $s_1$ as above. The result will be that the disturbing valleys in the frequency spectrum from the speech decoder 1 are reduced to a desired value before the final inverse transformation in block 4.

Depending on the slope $s_1$ of the frequency spectrum characteristic different average values of the spectrum magnitudes are obtained. The slope gives high magnitude values in the beginning of the frequency spectrum where the speech decoder 1 is "strong" i.e. is capable of decoding correctly independent of possible noise components in the spectrum. For higher frequencies, where the slope implies lower magnitude values of the spectrum characteristic, it is more important to perform a good suppression of the valleys in the characteristic.

The frequency diagram of FIG. 4 is intended to illustrate this. The smoothed frequency spectrum $s_m$ and its envelope e are compared as mentioned above and the difference is compared with a fix threshold $T_h$. This gives in this example at least two different frequency areas $f_1$ and $f_2$ around the frequencies $f_1$ and $f_2$, respectively for which the valleys $v_1$ and $v_2$ are regarded as disturbing i.e. due to non-harmonics/disturbing noise which the speech decoder cannot handle. Only these two frequency areas have been illustrated in FIG. 4 although several other such areas are present both in the lower and in the higher part of the frequency spectrum.

The signal $s_1$ from the comparator 61 carries information about what frequency areas $f_1$, $f_2$, . . . are to be suppressed and the signal $s_2$ from the slope detector 53 carries information about how great suppression is to be made. As mentioned above, if the detected frequency area is situated in the beginning of the spectrum as, for instance $f_1$, the suppression can be low while for area $f_2$ which is situated in the upper band, the suppression should be greater.

The dynamic unit 63 is adapting the suppression from one speech block to another. Preferably the incoming speech block (128 points) are treated with overlap so that when half a speech block has been processed in the blocks 5 and 6, the processing of a new subsequent speech block is started in the analyser block 5.

The dynamic unit 63 gives thus a signal which represents correction values to be subtracted from the spectrum characteristic which is done in the subtractor 31 corresponding to filter 3 in FIG. 1. The improved frequency spectrum of the speech signal is thereafter inverse transformed in the inverse Fast Fourier Transformer 4 as above described with respect to the overlapping speech blocks.

The method can also be applied to a signal internal to the speech or audio decoder. The signal will then be processed by the method and thereafter further used by the decoder to produce the decoded speech or audio signal. An example is the excitation signal in a LPC coder which can be processed by the proposed signal before the decoded speech is reconstructed by the linear prediction synthesis filter.

The fact that the method de-emphasises frequency areas in the decoded signal can be exploited during encoding such that the coding effort can be re-directed from the de-emphasised areas. For instance, the error weighting filter of an LPAS coder can be modified to lessen the weighting of the error in de-emphasised areas in order to accomplish this. Thus, the method can be used in conjunction with a modified encoder which takes the post-processing introduced by the method into account.

Merits of the Invention

Possibility to suppress coding noise and artifacts at localised frequency areas with high resolution. This is particularly useful for complex signals such as music. The method significantly enhances sound quality for complex signals while also enhancing the quality of pure speech although more marginally.

References

[1] D. Sen and W. H. Holmes, "PERCELP—Perceptually Enhanced Random Codebook Excited Linear Prediction", in Proc. IEEE Workshop Speech Coding, Ste. Adele, Que., Canada, pp. 101–02, 1993

What is claimed is:

1. A method for post-processing a decoded time domain signal received from a speech decoder in order to reduce non-harmonic and noise deficiencies within said signal, said method comprising the steps of:

a) performing a high-frequency resolution transform on the decoded signal to obtain a frequency spectrum of the decoded speech signal;

b) analyzing said frequency spectrum by estimating likely coding noise characteristics in various frequency areas based on the properties of the coding algorithm of the decoder from which the decoded signal was received, to identify disturbing frequency components;

c) identifying a degree of suppression for the disturbing frequency components; and d) performing high frequency resolution filtering of said frequency spectrum in order to significantly reduce disturbing frequency components in said frequency areas, based on the degree of suppression for the disturbing frequency components found in step c.

2. The method in claim 1, wherein said step of analyzing said frequency spectrum in various frequency areas is further based on decoder attributes.

3. The method in claim 1, wherein said step of analyzing said frequency spectrum in various frequency areas is further based on a perceptual model.

4. The method in claim 1, wherein said high frequency resolution filtering is further based on dynamic properties of the filter.

5. The method in claim 4, wherein said high frequency resolution filtering is further based on dynamic properties of the decoded signal.

6. A method for post-processing a decoded time domain signal received from a speech decoder in order to reduce non-harmonic and noise deficiencies in said signal, said method comprising the steps of:

a) transforming the decoded time domain signal to a frequency domain signal by means of a high frequency resolution transform (FFT);

b) analyzing the energy distribution of said frequency domain signal throughout its frequency area to find disturbing frequency components and to prioritize said disturbing frequency components which are situated in the higher part of the frequency spectrum;

c) finding a degree of suppression for said disturbing frequency components based on the prioritization of said disturbing frequency components;

d) post-filtering said frequency domain signal in dependence of the degree of suppression found in step c; and e) inverse transforming the post-filtered frequency domain signal in order to obtain a post-filtered decoded speech signal in the time domain.

7. Method according to claim 6, wherein said step of analyzing the energy distribution of said frequency domain signal comprises:

a) detecting the envelope of a signal representing said frequency spectrum and forming a corresponding envelope signal;

b) estimating the slope of said signal representing the frequency spectrum and forming a corresponding slope signal; and wherein said step of post-filtering said frequency domain signal comprises the steps of:

c) comparing said signal representing the frequency spectrum with said slope signal in order to locate said disturbing frequency components;

d) forming a value representing a degree of suppression for a specific frequency component based on the result of said comparing and said signal corresponding to the slope; and e) repeating said step of forming a value representing the degree to suppress a specific frequency component in order to obtain a number of values, said values being used to control said post-filtering of the frequency domain signal.

8. Method according to claim 6, further comprising the step of:

smoothing the frequency domain signal.

* * * * *